US005609788A

United States Patent [19]

Deetz

[11] Patent Number: 5,609,788

[45] Date of Patent: Mar. 11, 1997

[54] MAGNETIC PAINT ADDITIVE

[76] Inventor: Dayton J. Deetz, 43 Taft Ave., Mendon, Mass. 01756

[21] Appl. No.: 405,850

[22] Filed: Mar. 17, 1995

[51] Int. Cl.[6] ..... G09F 7/04

[52] U.S. Cl. ..... 252/62.54; 252/62.53; 252/62.55; 428/900; 428/692; 524/339; 524/440; 40/426; 40/449; 40/600; 40/621; 52/DIG. 4

[58] Field of Search ..... 428/900, 692; 252/62.53, 62.54, 62.55; 106/403, 456, 460; 40/426, 449, 600, 621; 524/339, 440; 52/DIG. 4

[56] References Cited

U.S. PATENT DOCUMENTS

| | | | |
|---|---|---|---|
| 2,418,479 | 4/1947 | Pratt et al. | 252/62.54 |
| 3,072,577 | 1/1963 | Miller et al. | 252/62.54 |
| 3,300,329 | 1/1967 | Orsino et al. | 117/49 |
| 3,413,135 | 11/1968 | Matson | 106/304 |
| 3,503,882 | 3/1970 | Fitch | 252/62.54 |
| 3,619,227 | 11/1971 | Tomkinson | 106/304 |
| 3,954,482 | 5/1976 | Novack | 106/1.14 |
| 4,129,548 | 12/1978 | McDonnell | 260/37 M |
| 4,421,660 | 12/1983 | Hajna | 252/62.54 |
| 4,597,801 | 7/1986 | Stratta et al. | 106/403 |
| 4,606,848 | 8/1986 | Bond | 252/511 |
| 4,834,800 | 5/1989 | Semal | 106/403 |
| 5,112,403 | 5/1992 | Okura et al. | 106/418 |

*Primary Examiner*—Melissa Bonner
*Attorney, Agent, or Firm*—St. Onge Steward Johnston & Reens

[57] ABSTRACT

Magnetic paint additives are formulated from ferromagnetic particles having a mixed particle range of from about 0.01μ to about 74μ, preferably from about 0.01μ to about 37 to 44μ. Iron powder is preferred. Preferred additives are formulated by blending the particles with a surfactant or surfactant mixture, or a surfactant and alcohol mixture, in amounts sufficient to suspend the particles. The additive may be blended with any oil-, latex-, or lacquer-based paint or coating to form a magnetic paint or coating having a viscosity substantially similar to the paint containing no particles and/or additive. Some embodiments employ from about 500 to about 2000 grams of particles per gallon of paint. One preferred additive embodiment comprises 2 to 3 parts 6 to 9 micron iron powder and 1 part surfactant. Surfaces such as wood, wall board, sheet rock, foam, plywood, plastic, fiberboard and the like so coated may be cut with conventional woodworking tools to form magnetic signs.

27 Claims, No Drawings

MAGNETIC PAINT ADDITIVE

TECHNICAL FIELD OF THE INVENTION

This invention relates to magnetic paint additives, paint or other coatings containing the additive, and substrates coated with the magnetic paint or coating.

BACKGROUND OF THE INVENTION

Metallic particles have been incorporated in previously described compositions, typically for use as metal repair formulations, metallic paint finishes, and colorants.

Orsino, et al., disclosed a process of polymerizing olefinic materials directly onto metal particles and particle clusters using an organometallic-transition metal catalyst system, and to processes of making articles from the encased metal materials by molding, casting or extruding (U.S. Pat. No. 3,300,329). A variety of metals were so treated in the examples, including lead, boron, mercury, copper, gold, magnesium, aluminum, silicon, sponge iron, iron-silicon, nickel, manganese, and chromium. In example 14, a ferromagnetic plastic disc of iron with 10.3% polyethylene was made.

In U.S. Pat. No. 3,413,135, Matson prepared novel iron oxide pigments by contacting an aqueous presscake of hydrated feric oxide with a mixture of an aromatic monocarboxylic acid such as benzoic acid and at least one higher fatty acid and working the mixture. A pigment was obtained upon separation and washing of the solid phase. Similarly, Tomkinson precipitated iron oxide with coloring matter to obtain pigments for bricks, plastics, textiles, and paints in U.S. Pat. No. 3,619,227. In one disclosed method, the coloring matter was formed in situ in an aqueous medium in which the precipitated iron oxide particles was suspended, and pigment was obtained from the suspension.

A corrosion-resistant primer or coating material containing stainless steel planar flakes of a rather critical geometry was disclosed by Novack in U.S. Pat. No. 3,954,482. The flakes, used only in certain proportions (about a pound per gallon primer), were ⅓μ in thickness and had a surface dimension of about 10μ to 40μ. The coating was disclosed as particularly efficacious as a one-coat anti-corrosive.

Okura, et al., also used plate-like particles in coating compositions for automobiles (U.S. Pat. No. 5,112,403). The particles were iron oxide, and had an average particle diameter of 0.5 to 5.0μ, a lamillar thickness of 50 to 500 Å and a plate ratio of 50:1 to 500:1. The composition further contained at least one pigment, a film-forming polymer, and an organic solvent.

In U.S. Pat. No. 4,129,528, McDonnell disclosed a two component system comprising a liquid polymerizable resin and a hardener, wherein one or both components contained a ferrosilicon alloy. On mixing the two components together, polymerization occurred, forming a composition useful as a metal repair or reclamation material.

Colloidal size particles such as an inorganic solid (titanium dioxide or magnetic iron oxide) encapsulated in a hydrophobic polymer such as a styrene polymer were disclosed in U.S. Pat. No. 4,421,660 to Hajna. They were disclosed as useful for a variety of applications, including separations, radiation absorption, magnetic paints, electrically resistive barriers, toners in electrophotographic applications, electroconductive additives for plastics, pigments in paint and ink formulations, and diagnostic materials. However, the process for preparing the matrix particulates was fairly complicated. It involved a polymerization wherein a hydrophobic monomer was dispersed in an aqueous colloidal dispersion of the inorganic particles that were preferably 0.005 to 0.1μ in size and then subjected to emulsion polymerization. The polymerizations generally employed free radicals; typical reactions involved heating with agitation under nitrogen and then adding a catalyst or free radical initiator. The matrix particulates so formed were separated from the aqueous continuous phase of the dispersion by conventional means such as drying.

Stratta and Stasiak dispersed ferromagnetic powder using a novel dispersing agent containing silylated alkylene oxide copolyethers or isocyanatoalkyl silanes in combination with phosphate esters for use in the manufacture of magnetic coatings for audio and video tape (U.S. Pat. No. 4,597,801). To achieve high information density storage on the tapes, the powders employed were of a very fine, high quality type that exhibited high coercive strength required by the electronics industry. For example, a cobalt-doped magnetic iron oxide particle size illustrated was 0.2μ in length; another that was not doped was 0.06μ by 0.35μ (column 11, lines 29 to 35).

In U.S. Pat. No. 4,834,800 to Semel, iron or steel powders were mixed with an alloying powder and a binding agent exhibiting certain properties. The agent was a film-forming resin insoluble in water comprising a vinyl acetate or methacrylate polymer, a cellulosic ester or ether resin, or an alkyd, polyurethane or polyester resin. The specific binding agents were disclosed as useful in enhancing the physical properties of the powder or sintered articles made from the powder. Where the binding agent was a substance that pyrolyzed relatively cleanly, residues of carbon or other chemicals were avoided during sintering of the composition.

Though many and varied, none of these patents disclose a magnetic paint or coating, or paint additive, that is simple to make and use, and inexpensive.

SUMMARY OF THE INVENTION

It is an object of the invention to provide a magnetic paint additive useful for paints or other coatings.

It is a further and more specific object of the invention to provide a magnetic paint additive that is economical, easy to use, and useful in oil, latex, or lacquer-based paints and coatings.

These and other objects are achieved by the present invention, which provides a magnetic paint additive comprising a mixture of ferromagnetic particles ranging in size from about 0.01μ to about 250μ, preferably from about 0.01μ to about 74μ, more narrowly from about 0.01μ to 37to 44μ. When added to paint in amounts that do not substantially change the viscosity of the paint, this particle size and range blends right in with the paint and is particularly efficacious in providing a smooth magnetic surface when the paint has dried. Preferred ferromagnetic particles comprise iron powder. In some embodiments, about 500 grams to 2000 grams of iron powder or other ferromagnetic particles are added per gallon of paint.

In preferred embodiments, magnetic paint additives comprise ferromagnetic particles and a surfactant or surfactant mixture, or a surfactant/alcohol mixture, blended with the particles in amounts sufficient to form a dispersion which can then be conveniently used by simply blending with the paint or coating additive. In some embodiments, about 5 to 90 parts ferromagnetic particles are simply added to 100 parts magnetic paint additive, but the amount varies depending on the nature of the particles and the additive. As illustrated hereafter, some magnetic paint additive embodiments employ higher amounts of particles, e.g., 2 to 3 parts particles per part surfactant.

Paint additives of the invention so formulated are then be simply blended into any oil-, latex- or lacquer-based paint or coating in proportions that do not significantly change the viscosity of the paint (i.e., by no more than about 25%), and then painted on a surface in a conventional manner. As mentioned above, in some embodiments, from about 500 grams to 2000 grams of particles are employed per gallon of paint. Upon drying, the painted surface is metallic. Thus, this invention encompasses metallic paints.

This invention also encompasses magnetic sign boards because surfaces such as rigid wall board, wood, sheet rock, foam, plywood, plastic, fiberboard, and the like painted with magnetic paint of the invention can be cut on site with conventional woodworking tools to provide signs.

DETAILED DESCRIPTION OF THE INVENTION

This invention is based upon the finding that powdered iron of a certain mesh size range provides an inexpensive and simple paint additive that can be combined with a variety of paint and coating types that, when dried, form a magnetic paint or coating. Preferred additives are mixtures of ferromagnetic particles and at least one surfactant to facilitate mixing with the paint or coating.

In the practice of the invention, ferromagnetic particles of a mesh size greater than 50, i.e., having a particle size of about 297μ or smaller, preferably smaller than 250μ (60 mesh), are typically mixed with surfactant. Mixtures of particle sizes yield superior surfaces, and use of different size ranges can be varied to yield different surface texture characteristics. For example, a coarse surface is obtained by use of 50 to 400 mesh particles (37μ to 297μ). Use of a finer particle mixture, e.g., as small as 0.1μ to 10μ, yields smoother surfaces.

For superior results on conventional painted surfaces such as plaster walls, wallboard, or interior woodwork, preferred particles exhibit a mixture of sizes that vary up to about 74μ (i.e., 200 mesh or higher), more narrowly up to 44μ (325 mesh), and even more narrowly up to 37μ (400 mesh). Thus, in one embodiment, the particles range from about 0.01μ to about 75μ. In another embodiment, the particles range from about 0.01μ to about 44μ (325 mesh). In yet another embodiment, the particles range from about 0.01μ to about 37μ (400 mesh).

Use of a broad range of mesh sizes, e.g., 1μ to 75μ, results in good adhesion and a strong, flat metallic surface after drying. The inclusion of larger particles yields a superior magnetic product exhibiting stronger magnetism (holding power) for various applications, so use of a broad range also makes the magnetic paint easier apply smoothly, and the finish of the dried product is superior.

Any type of ferromagnetic particle may be used in the practice of the invention. Ferromagnetic particles useful in the present invention include, but are not limited to, powdered iron, magnetic iron oxide, magnetic powdered steel, and magnetic iron alloys with nickel, zinc, copper, and the like, and mixtures thereof. Oxidized iron is generally not preferred as it tends to discolor the paint, particularly when used in water-based paints. Powdered iron is preferred in one embodiment.

Though the ferromagnetic particles may be added directly to any paint or coating composition to provide a magnetic paint, as mentioned above, many preferred embodiments employ a wetting agent or emulsifier to assist in the dispersion of the particles in the paint. Any wetting agent or emulsifier, or combination of wetting agents and/or emulsifiers, that form a stable dispersion with the ferromagnetic particles may be employed. The emulsifiers may be anionic, cationic or neutral. Useful surface active or wetting agents include, but are not limited to, ethylene glycol and/or propylene glycol, condensates of ethylene oxide with propylene oxide, fatty acid salts such as sodium/potassium oleate, metal alkyl sulfates such as sodium lauryl sulfate, salts of alkyl aryl sulfonic acid such as sodium dodecylbenzene sulfonate, polysoaps, polyoxyethanols, and the like. Ethylene glycol, propylene glycol, or mixtures thereof are employed in some embodiments. Conventional paint additive surfactants such as Merpol® OJ or Merpol® SH, nonionic ethylene oxide-based surfactants or Alkanol ACN® obtainable from DuPont are employed in other embodiments.

Mixtures of surfactants with solvents such as alcohols can also be employed; diacetone alcohol combined with a surfactant is preferred in these embodiments. In some embodiments, mixtures of Merpol® OJ, Merpol® SH, or Alkanol ACN® with diacetone alcohol are employed. These are formulated to provide a final paint formulation exhibiting a viscosity suitable for smooth spreading, and typically contain up to 50% of the alcohol using conventional paint mixing techniques known to those skilled in the art. Examples are given hereafter.

The choice of surfactants depends to some extent on the paint base into which the additive is mixed. As illustrated in the examples hereafter, it has been found that use of certain surfactants with iron powder may affect the viscosity of the paint so that a solvent such as an alcohol may be needed to obtain a paint with a satisfactory consistency. Some surfactants, e.g., Merpol® OJ, are pastes that require dilution with a solvent such as alcohol prior to use. Drying time may also be affected when certain surfactants are used with certain paint bases. In many embodiments, Merpol® OJ or Alkanol ACN® or a mixture of these with each other or with an alcohol may be preferred because these surfactants are suitable for latex-, oil- and lacquer-based paints.

Preferred embodiments yield a wet magnetic paint having the consistency of a thick cake batter, i.e., appropriate for good spreading. An advantage of the invention is that those skilled in the art are accustomed to blending paints with other paints and paint additives, so that obtaining a paint with an appropriate viscosity does not present a problem in the practice of the invention.

Particles are added directly to the paint or to an additive and then the paint in amounts that do not change the viscosity of the paint significantly. Preferred embodiments change the viscosity of the final paint by less than 25%; particularly preferred embodiments change the viscosity by less than about 15%, and, in some embodiments, less than about 10%. Typically, about 500 grams to 2000 grams of particles are used per gallon of paint.

In one embodiment, about 5 to 90 parts ferromagnetic particles are employed in 100 parts magnetic paint additive. In other embodiments, about 2 to 3 parts particles are mixed with one part surfactant to yield magnetic paint additives of the invention. Specific examples are given hereafter. The surfactant or surfactants are simply blended with the ferromagnetic particles. It is an advantage of the invention that the paint additive containing the particles can be mixed with a portion of top coat paint, so that the purchase of only one paint is required in the practice of the invention.

An advantage of the invention is that the magnetic paint additive may be added to any oil-, latex- and lacquer-based paints and fluid coatings. It is simply mixed in, and requires no special processing or polymerization steps. For most paints, the magnetic paint can be used in a one-coat operation. It can thus be used to create a magnet attracting surface virtually anywhere one can paint. It can also be used as a primer under wallpaper. Magnetic paint is ideal for message centers, conference rooms, school (class and dorm) rooms, homes, offices, cupboard interiors, workshop walls, and the like, eliminating thumb tacks and tape for messages, posters, artwork, and interactive displays.

By using mache unit (MU) metal instead of iron powder, electromagnetic force (E.M.F.) reducing magnetic paint is formulated. This is useful for isolating electrical fields, to shield electrical guitars and scientific equipment, and the like. It is also useful for painting the walls of a child's room or the like to reduce E.M.F. penetration from the environment into homes and schools. Walls so coated have the advantage of being magnetic. Another advantage of the invention is that it can be used to make magnetic sign boards. Magnetic paint can be applied to rigid wall board, wood, sheet rock, foam, foam board, plywood, plastic or fiberboard that can be cut on site with conventional woodworking tools. The signs have many applications in schools, restaurants, offices, tradeshows, stores, and the like. When mixed with various types of stone, magnetic paint can also be used to make chalkboards that are magnetic. Examples are given hereinafter.

The following examples are presented to further illustrate and explain the present invention and should not be taken as limiting in any regard. Unless otherwise mentioned, all parts and percentages are by weight, and are based on the weight at the particular stage of the processing being described.

EXAMPLES

Examples 1

In this example, ferromagnetic particles useful as a magnetic paint additive are analyzed.

One analysis of a metallic powder useful in the invention shows an iron base that contains 0.15 to 0.2% carbon, 0.6 to 0.9% molybdenum, 0.04% phosphorus (maximum), and 0.05% sulfur. The specific gravity is 7.83 and the melting point is 1430° C. The powder contains the following particle size range:

| screen size | weight % |
|---|---|
| 200 | 0.3 |
| 230 | 14.9 |
| 270 | 23.6 |
| 325 | 13.0 |
| 400 | 16.3 |
| [PAN | 31.9] |

Another powder useful in the invention is 99.5% iron, and has a particle size range of 6μ to 9μ. Yet another powder is a MU mixture of molybdenum and iron.

Example 2

This example describes several magnetic paint additives that can be prepared for use in making magnetic paints according to the invention.

One part Alkanol ACN® obtained from DuPont was mixed with one part diacetone alcohol to form a wetting agent and then 6 parts 6–9 micron iron powder was added to form a magnetic additive that performed well in both oil- and latex-based paints when added to them in amounts sufficient to yield a consistency like that of cake batter or honey. Undiluted with alcohol, the same surfactant performed well with iron powder in oil-based paint, but it did not disperse the particles well in latex-based paint.

One part Merpol® SH obtained from DuPont was mixed with one part diacetone alcohol to form a wetting agent to which 4½ parts 6 to 9 micron iron powder were added to form an additive that performed well with both oil- and latex-based paint. The same surfactant performed without dilution with alcohol prior to adding the iron powder. Alcohol could be added directly to the metallic paint containing the metallic additive and paint to alter viscosity to a thick cake batter or honey consistency if the paint thickened on standing or overnight storage.

Another additive was prepared by mixing one part Merpol® OJ obtained from DuPont with one part diacetone alcohol and 6 parts 6 to 9 micron iron powder. This performed well as an additive with both oil- and latex-based paints. The surfactant could not be used without the alcohol solvent dilution because it was a thick paste.

All three DuPont products performed well in the paints, yielding superior metallic paint surfaces after drying.

Example 3

A magnetic paint additive is made by mixing 30 to 40 parts powdered iron having a mixed mesh size ranging from 0μ to 74μ (200 mesh) with 70 parts ethylene glycol ($N^{20}$ 1.4670; $d^{D}$ 1,128). When mixed with oil-base paint, the magnetic paint so formed performs and dries like paint containing no additive. When mixed with latex-base paint, the magnetic paint performs like paint containing no additive, but the drying time is slowed somewhat.

Example 4

Magnetic sign boards are prepared by spraying a paint of Example 1 on medium density fiber board. The coating dries to a thickness of about 0.002" to 0.01". The product is magnetic and can be cut on sight with conventional woodworking tools.

A magnetic chalkboard is prepared by mixing iron powder in a desired color of paint and then adding rotton stone and F.F. pumas. This dries flat, leaving a chalk-board surface that is magnetic.

Example 5

An E.M.F. reducing magnetic paint is made by mixing MU metal particles known to those skilled in the art with surfactants as in Example 2 above.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention as defined in the appended claims. The claims are meant to cover the claimed components and steps in any sequence which is effective to meet the objectives there intended, unless the context specifically indicates the contrary.

I claim:

1. A magnetic sign board comprising a substrate painted with a paint comprising paint and, per gallon of said paint, from about 500 to about 2000 grams ferromagnetic powder having a mixed particle size varying from about 0.01μ to about 44μ.

2. A sign board according to claim 1 wherein the ferromagnetic powder is iron powder.

3. A sign board according to claim 1 wherein the particle size ranges from about 0.01μ to about 37μ.

4. A sign board according to claim 3 wherein the particle size ranges from about 6μ to about 9μ.

5. A sign board according to claim 1 wherein the substrate is selected from the group consisting of rigid wall board, wood, sheet rock, foam, foam board plywood, plastic, chalkboard and fiberboard.

6. A sign board according to claim 5 wherein the substrate is foam board.

7. A sign board according to claim 5 wherein the substrate is chalkboard.

8. A sign board according to claim 1 wherein the paint is a latex paint.

9. A method for providing a magnet attracting surface on a substrate, comprising a) formulating a paint additive comprising iron powder having a particle size which ranges from about 0.01μ to about 250μ and a surfactant, b.) blending the additive into paint in an amount such that the paint and additive mixture comprises from about 500 grams to about 2000 grams of iron powder per gallon of paint, and further wherein the additive is present in the paint in an amount such that the viscosity of the paint is changed by 25% or less when compared with the paint not having the additive present; and c) applying the paint and additive mixture to a substrate which comprises wall board, wood, sheet rock, foam, foam board, plywood, plastic, chalkboard or fiberboard so as to provide a magnet attracting surface on the substrate.

10. The method of claim 9 wherein the particle size of the iron powder ranges from about 0.1μ to about 74μ.

11. The method of claim 9 wherein the substrate is foam board.

12. The method of claim 9 wherein the substrate is chalkboard.

13. The method according to claim 9 wherein the paint is a latex paint.

14. A method for making a magnetic paint comprising (a) formulating a magnetic paint additive comprising ferromagnetic powder having a mixed particle size varying from about 0.01μ to about 250μ and a surfactant; and (b) admixing said paint additive with a conventional paint in amounts that change the viscosity of the paint not having the additive present by about 25% or less.

15. A method according to claim 14 wherein the paint is a latex paint.

16. A method according to claim 14 wherein the ferromagnetic powder is iron powder.

17. A method according to claim 14 wherein the particle size ranges from about 0.01μ to about 74μ.

18. A method according to claim 14 wherein the particle size ranges from about 0.01μ to about 37μ.

19. A method according to claim 14 wherein the additive changes the viscosity of the paint by about 15% or less.

20. A method according to claim 14 wherein the magnetic paint contains from about 500 to 2000 grams ferromagnetic powder per gallon.

21. A magnetic paint made according to the method of claim 14.

22. A method of using a magnetic paint additive comprising (a) formulating a magnetic paint additive comprising ferromagnetic powder having a mixed particle size varying from about 0.01μ to about 250μ and a surfactant;

(b) blending said additive into a conventional paint in an amount such that the viscosity of the paint is changed by 25% or less when compared with the paint not having the additive present; and (c) applying the paint and additive mixture to a substrate, thereby providing a magnet attracting surface to said substrate.

23. A method according to claim 22 wherein said surfactant comprises ethylene glycol or is ethylene oxide-based.

24. A method according to claim 22 wherein the ferromagnetic powder is iron powder.

25. A method according to claim 22 wherein the particle size of the powder ranges from about 0.01μ to about 74μ.

26. A method according to claim 25 wherein the particle size of the powder ranges from about 0.01μ to about 37μ.

27. A method according to claim 22 wherein the substrate is selected from the group consisting of wall board, wood, sheet rock, foam, foam board, plywood, plastic, chalkboard, and fiberboard.

* * * * *